United States Patent [19]

Fitzgibbons

[11] 4,343,492

[45] Aug. 10, 1982

[54] MULTIPLE PLY ADHESIVE BUSINESS FORM

[75] Inventor: Gary W. Fitzgibbons, Prairie View, Ill.

[73] Assignee: UARCO Incorporated, Barrington, Ill.

[21] Appl. No.: 297,438

[22] Filed: Aug. 28, 1981

Related U.S. Application Data

[63] Continuation of Ser. No. 131,250, Mar. 17, 1980, abandoned.

[51] Int. Cl.[3] ..... B41L 1/24; B65D 27/00

[52] U.S. Cl. ..... 282/11.5 R; 229/74

[58] Field of Search ..... 282/8 R, 8 B, 11.5 A, 282/11.5 R, 22 R; 283/18, 19, 21; 229/74

[56] References Cited

U.S. PATENT DOCUMENTS 3,987,960 10/1976 Gardiner ..... 282/22 R 4,153,163 5/1979 Alderman ..... 229/74 X

*Primary Examiner*—Paul A. Bell

*Assistant Examiner*—John S. Brown

*Attorney, Agent, or Firm*—Wegner, McCord, Wood & Dalton

[57] ABSTRACT

A business form including first and second superimposed plies of paper (10,12) and each having an information receiving portion (14,16). Contact adhesive (30) is disposed on one of the plies and a release liner (32) covers the same. The ply (12) having the contact adhesive (30) is completely slit (26) adjacent one edge and an easily releasable glue structure (38) secures the two plies together adjacent the slit (36). The release liner (32) is removed from the form to expose the contact adhesive simply by grasping the edges (18,20) of the plies (10,12) adjacent the slit (36) and separating the same.

4 Claims, 4 Drawing Figures

MULTIPLE PLY ADHESIVE BUSINESS FORM

This is a continuation, of application Ser. No. 131,250 filed Mar. 17, 1980 and now abandoned.

TECHNICAL FIELD

This invention relates to a business form, and more particularly, to a multiple ply business form, at least a part of which is to be adhered to another object.

BACKGROUND ART

Many business forms such as mailing labels, invoices, as well as a variety of others, are provided with an adhesive whereby part of or all of the form may be adhered to another object. In some cases, the adhesive employed is a remoistenable adhesive. Their use requires a source of moisture for remoistening the adhesive such as a sponge, brush or the like. Consequently, use of such forms can be somewhat messy due to the moisture that must be added to the adhesive.

Moreover, if too much moisture is applied to the adhesive, the adhesive becomes diluted and has insufficient strength to create a secure bond between the business form and the object to which it is to be adhered.

Consequently, there has been increasing use of paper provided with pressure sensitive adhesive on one face thereof rather than a remoistenable adhesive in the production of such forms. The use of pressure sensitive adhesive requires the presence of an additional element in the form construction, namely, a so-called "release liner" which completely covers the pressure sensitive adhesive and which must be removed to expose the adhesive when the form is to be adhered to another object. Typically, the release liner is formed of a relatively waxy silicone coated paper which adheres to the pressure sensitive adhesive to some degree but is sufficiently compatible therewith as to be easily removed from the paper backed with the pressure sensitive adhesive by the simple act of peeling.

To facilitate removal of the release liner, the same is usually slit at one or more locations. By arching the form in the vicinity of the slit, the edges of the release liner at the slit lose their adherence to the pressure sensitive adhesive and project away from the arched face of the form so that they may be grasped manually and pulled to remove the release liner from the form.

The process is a relatively easy one but is nonetheless not without its drawbacks. For one, because the release liner is slit, it is necessary to twice perform the act of removal since the slit divides the release liner into two parts, each of which must be removed. Additionally, if some care is not taken in the process of arching the form to release the edges of the release liner from the pressure sensitive adhesive, the form may be permanently bent or wrinkled giving it an undesirable appearance.

And where the business form with pressure sensitive adhesive is a multiple ply form, a further difficulty may present itself. In the manipulative steps required to remove the release liner, there comes the possibility that one or more plies of the multiple ply form may become dissociated from the remainder of the form prematurely if some care is not exercised to prevent such an occurrence.

DISCLOSURE OF THE INVENTION

The present invention is directed to overcoming one or more of the above problems.

According to the invention there is provided a business form comprising first and second superimposed plies of paper, each including information receiving portions, the information receiving portion of the second ply being somewhat shorter than the first ply and underlying the first ply information receiving portion. Image transfer means are disposed at the interface of the first and second plies and pressure sensitive adhesive is disposed on the face of the second ply remote from the first ply. A release liner of a size and shape corresponding to that of the first ply is adhered to the pressure sensitive adhesive and is removable therefrom to expose the pressure sensitive adhesive so that the second ply may be adhered to another object. The release liner extends past the second ply information receiving portion to underlie the portion of the first ply that is longer than the second ply information receiving portion. Means secure the first ply to the second ply information receiving portion in close adjacency to the longer portion of the first ply. The easily releasable means has greater strength than the adhesion between the release liner and the pressure sensitive adhesive.

As a result of this construction, the release liner may be easily removed from the second ply information receiving portion by separately grasping the portions of the first ply and the release liner that extend beyond the second ply receiving portion and separating the same. The construction eliminates any need for arching the form to release edges of the release liner from the pressure sensitive adhesive and its use requires only one act of removal for the entire release liner. Because of the simplicity of the removal act, the possibility of part of the multiple ply form being separated prematurely from the remainder is minimized.

Other objects and advantages will become apparent from the following specification taken in connection with the accompanying drawings.

BEST MODE FOR CARRYING OUT THE INVENTION

Figure 1:
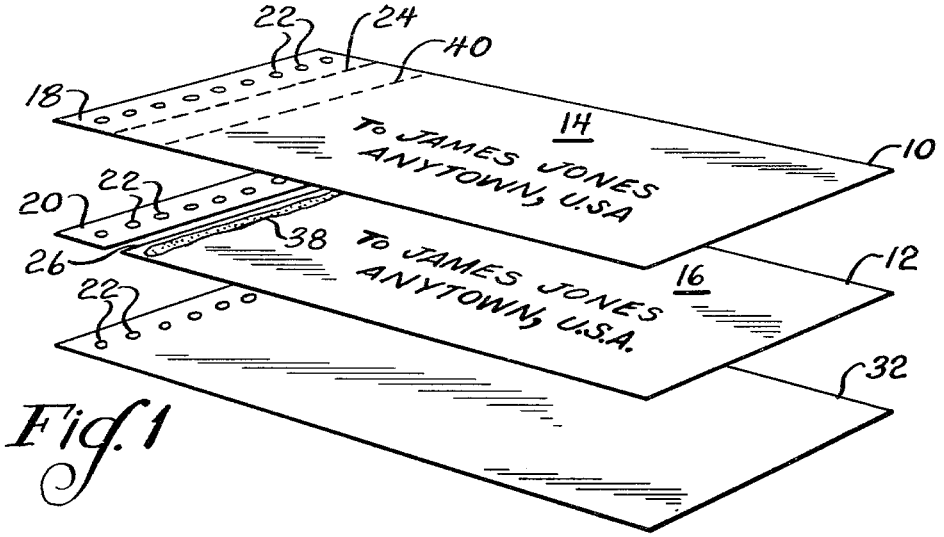
FIG. 1 is an expanded view of one embodiment of a business form made according to the invention.
Figure 2:
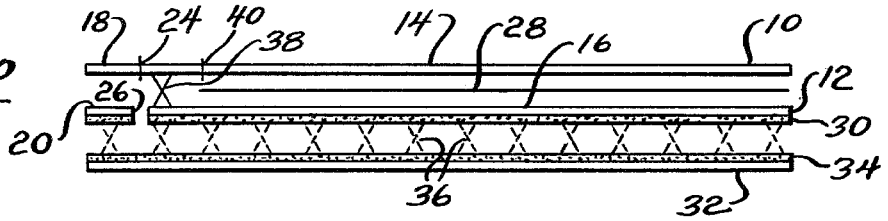
FIG. 2 is a schematic view of the business form.

An exemplary embodiment of a business form made according to the invention is illustrated in the drawings and with references to FIGS. 1 and 2 is seen to be a two-ply business form such as a mailing label or the like. However, it is to be understood that the invention is not limited to mailing labels, but can find utility in any application where part of a multiple ply business form is to be adhered to another object. In a like vein, the invention is not restricted to two-ply forms, but can be used with efficacy in forms having a greater number of plies. It will likewise be observed that while a single form is illustrated in the drawings, sometimes termed a so-called "unit set", the invention is not restricted to use in forms supplied to a customer or the like as unit sets but can also be used in forms supplied to a customer in continuous form for subsequent separation into individual form lengths by the customer.

Referring specifically to FIG. 1, the form includes an upper ply 10 and a lower ply 12. As oriented in FIG. 1, the large righthand parts of each of the plies 10 and 12 constitute information receiving areas 14 and 16 respectively. The lefthand edges of each of the plies 10 and 12 are control punched margins 18 and 20 and usually are no more than about a half an inch in width. The control punched margins 18 and 20 include pinfeed holes 22 for cooperation with pinfeed devices in processing equipment employed during manufacture and/or use of the form as is well known.

The control punch margin 18 for the ply 10 is separated from the remainder thereof by a line of weakening 24, usually in the form of a perforation. In contrast, the pinfeed margin 20 for the ply 12 is completely severed therefrom by a slit 26.

Referring specifically to FIG. 2, between the information receiving areas 14 and 16 of the plies 10 and 12 there is disposed an image transfer means shown schematically at 28. The image transfer means may be a thin sheet of carbon paper or it could constitute spot carbon on the underside of the ply 10. Alternately, it could be any one of a variety of available image transfer mediums such as a chemically coated back on the ply 10 and a color forming reactive chemical coating on the front of the ply 12. Or, microcapsule systems as image transfer means 28 is disposed at the interface of the plies 10 and 12 so that information marked on the information receiving area 14 of the ply 10 will be transfered to the information receiving area 16 of the ply 12.

The back or underside of the ply 12, that is, the face of the ply 12 remote from the image transfer means 28, is entirely coated with any conventional pressure sensitive adhesive 30.

The form includes a conventional release liner 32 having a silicone coating 34 facing the pressure sensitive adhesive 30 and releasably bonded thereto as schematically illustrated at 36.

The form further includes a securing means interconnecting the plies 10 and 12. As seen in FIGS. 1 and 2, a glue or adhesive line 38 interconnects the information receiving areas 14 and 16 of the plies 10 and 12 at a location immediately adjacent the slit 26. It will be observed that the glue line 38 is not disposed in the control punch margins 18 or 20. The glue employed in forming the line 38 is any of a number of well known glues. Means other than glue may form the securing means so long as they provide a securement that is stronger than the adhesion between the pressure sensitive adhesive 30 and the release liner 32.

With the foregoing in mind, a strong adhesive may be used in forming the glue line 38 and where the same is sufficiently strong that the bond cannot be broken without tearing one or the other or both of the plies 10 and 12, a line of weakening in the form of a perforation line 40 may be provided in the ply 10 to allow separation of the information receiving area 14 thereof from the ply 12. Alternately, if the adhesive utilized in forming the glue line 38 is relatively weak in the sense that the bond can be broken without tearing either or both of the plies 10 and 12, the line of perforation 40 may be omitted. Such a relatively weak glue, however, must still retain the characteristic of providing a bond stronger than the adhesion between the pressure sensitive adhesive 30 and the release liner 32.

INDUSTRIAL APPLICABILITY

In use, whatever information is desired to be carried by the form is inscribed in the information receiving area 14 of the ply 10 which will result in its application to the information receiving area 16 of the ply 12 as well via the image transfer means 28. The form, if in continuous form, can then be separated from other forms for application to another object. Obviously, if the form is a so-called unit set, such separation need not occur.

Figure 3:
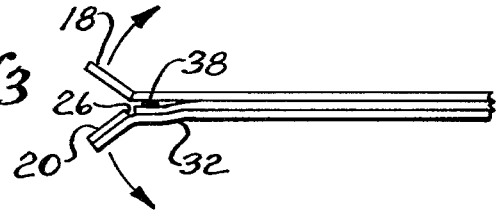
FIG. 3 is a fragmentary, schematic view of the initial stage of the step of removal of a release liner from the form.
Figure 4:
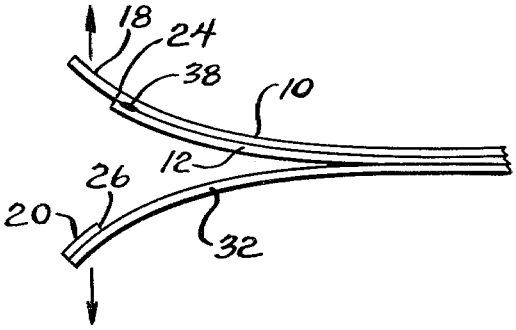
FIG. 4 is a schematic view of a later stage in the step of removal of the release liner.

In order to remove the release liner 32 so that the form may be adhered to another object by the pressure sensitive adhesive 30, one need only separately grasp the control punch margins 18 and 20 to separate the same in the manner illustrated in FIG. 3. Continued pulling in the direction of arrows as illustrated in FIG. 4 will result in the release liner being removed from the image receiving portion of the ply 12 in a single step without arching the form. During this process, the adhesion produced by the glue 38 secures the information receiving portion 16 of the ply 12 to the ply 10 while force is being exerted on the control punch margin 18 of the latter. The presence of the slit 26 allows the control punch margin 20 of the ply 12 to remain with the release liner 32.

Once the release liner 32 is fully removed from the remainder of the form, the second ply 12, and specifically, the information receiving area 16 thereof, can be adhered to another object. Removal of the ply 10 can be accomplished as desired dependent upon the specific intended use of the form.

It will therefore be appreciated that a multiple ply business form made according to the invention eliminates the difficulties associated with forms utilizing a remoistenable glue and appreciably simplifies the acts required for removal of a release liner in forms employing pressure sensitive adhesive. Single step release liner removal without arching of the form that could cause wrinkling is provided. Manipulation of the form during the removal process is at an absolute minimum thereby minimizing the possibility that part of the form will become prematurely dissociated from the remainder thereof.

I claim:

1. A business form comprising:

first and second superimposed plies of paper each including information receiving portions;

image transfer means at the interface of said first and second plies;

pressure sensitive adhesive on the face of one of said plies opposite said image transfer means;

a release liner releasably adhered to said pressure sensitive adhesive and removable therefrom to expose the pressure sensitive adhesive so that said one ply may be adhered to another object;

a slit extending through said one ply, but not through said release liner, severing the same into a gripping portion in addition to the associated information receiving portion; and means securing the other ply to said one ply information receiving portion in close adjacency to said slit, said securing means having greater strength than the adhesion between said release liner and said pressure sensitive adhesive;

whereby said release liner may be removed from said one ply information receiving portion by separately grasping said gripping portion and said other ply and separating the same.

2. A business form comprising:

first and second superimposed plies of paper each having a control punched margin along one edge thereof and an information receiving portion;

image transfer means at the interface of said first and second plies;

pressure sensitive adhesive on substantially the entirety of the face of one of said plies opposite said image transfer means;

a release liner releasably adhered to said pressure sensitive adhesive and removable therefrom to expose the pressure sensitive adhesive so that said one ply may be adhered to another object;

a slit extending through said one ply, but not through said release liner, completely severing the corresponding control punched margin from the associated information receiving portion; and glue means securing the other ply to said one ply information receiving portion in close adjacency to said slit, said glue means not being located in the control punched margin of either of said plies and having a greater strength than the adhesion between said release liner and said pressure sensitive adhesive;

whereby said release liner may be removed from said one ply information receiving portion by separately grasping each of said control punched margins and separating the same.

3. A business form comprising:

first and second superimposed plies of paper, each including information receiving portions;

image transfer means at the interface of said first and second plies;

pressure sensitive adhesive on substantially the entirety of the face of one of said plies opposite said image transfer means;

a release liner releasably adhered to and covering said pressure sensitive adhesive and removable therefrom to expose the pressure sensitive adhesive so that said one ply may be adhered to another object;

a slit extending through said one ply, but not through said release liner, in close adjacency to an edge of said one ply to sever the same into a gripping portion in addition to the associated information receiving portion; and means inwardly of an edge of said other ply and securing said other ply to said one ply information receiving portion in close adjacency to said slit, said securing means having greater strength than the adhesion between said release liner and said pressure sensitive adhesive;

whereby said release liner may be removed from said one ply information receiving portion by separately grasping said gripping portion and said edge of said other ply and separating the same.

4. A business form comprising:

first and second superimposed plies of paper, each including information receiving portions, said second ply underlying said first ply and defining an edge spaced inwardly from an edge of the first ply to define an access position under the first ply at said edge thereof;

image transfer means at the interface of said first and second plies;

pressure sensitive adhesive on the face of said second ply remote from said first ply;

a one piece release liner of a size and shape corresponding to that of said first ply adhered to said pressure sensitive adhesive and removable therefrom to expose the pressure sensitive adhesive so that said second ply may be adhered to another object, said release liner having a grasping portion extending beyond said second ply edge to be disposed at said access position for manual grasping thereof; and adhesive means securing said first ply to said second ply information receiving portion inwardly adjacent said edge, said adhesive means having greater strength than the adhesion between said release liner and said pressure sensitive adhesive, whereby said release liner may be removed from said second ply information receiving portion by separately grasping the portions of said first ply and said release liner that extend substantially beyond said second ply edge and separating the same.

* * * * *